United States Patent [19]

Igashira et al.

[11] Patent Number: 4,480,619

[45] Date of Patent: Nov. 6, 1984

[54] FLOW CONTROL DEVICE

[75] Inventors: Toshihiko Igashira, Toyokawa; Yasuyuki Sakakibara, Nishio; Toru Yoshinaga; Seiko Abe, both of Okazaki; Kazuhide Watanabe, Toyohashi, all of Japan

[73] Assignee: Nippon Soken, Inc., Nishio, Japan

[21] Appl. No.: 501,788

[22] Filed: Jun. 7, 1983

[30] Foreign Application Priority Data

| | | | |
|---|---|---|---|
| Jun. 8, 1982 | [JP] | Japan | 57-99031 |
| Apr. 11, 1983 | [JP] | Japan | 58-62243 |
| Apr. 11, 1983 | [JP] | Japan | 58-62244 |
| May 16, 1983 | [JP] | Japan | 58-84050 |
| May 16, 1983 | [JP] | Japan | 58-84051 |
| May 16, 1983 | [JP] | Japan | 58-84052 |

[51] Int. Cl.[3] ..... F02B 3/00

[52] U.S. Cl. ..... 123/446; 123/458; 123/459; 123/460

[58] Field of Search ..... 123/446, 458, 459, 460, 123/467

[56] References Cited

U.S. PATENT DOCUMENTS

| | | | |
|---|---|---|---|
| 3,516,395 | 6/1970 | Bassot et al. | 123/446 |
| 3,837,324 | 9/1974 | Links | 123/458 |
| 4,184,459 | 1/1980 | Ishii et al. | 123/467 |
| 4,249,497 | 2/1981 | Eheim et al. | 123/446 |
| 4,418,671 | 12/1983 | Kelso et al. | 123/458 |

FOREIGN PATENT DOCUMENTS

| | | | |
|---|---|---|---|
| 121334 | 9/1979 | Japan | 123/467 |
| 81153 | 5/1982 | Japan | 123/446 |

*Primary Examiner*—Magdalen Y. C. Moy

*Attorney, Agent, or Firm*—Cushman, Darby & Cushman

[57] ABSTRACT

A flow control device advantageously used in a fuel injection system for a diesel engine. The flow control device includes a spool valve defining on its sides first and second chambers which are connected with each other by means of a throttle. The second chamber is connected to a high pressure pipeline connecting a fuel pump with a fuel injector, while the first chamber is selectively opened to a relief line by means of an electrically operated valve. A cylinder has an annular groove opened to the relief line. When the valve is opened, the first chamber is opened to the relief line. A pressure difference is thus created between the first and the second chambers so as to move the spool valve to open. Thus fuel injection is stopped.

45 Claims, 10 Drawing Figures

FLOW CONTROL DEVICE

BACKGROUND OF THE INVENTION

1. Field of the Invention

The present invention relates to a system for controlling fuel injection in an internal combustion engine, more particularly to a flow control device used in such a system to control fuel injection timing, a fuel injection rate, or a fuel injection amount.

2. Description of the Prior Art

In an internal combustion engine, particularly a diesel engine, precise control of fuel injection is necessary to attain optimal performance for every engine operational condition. To attain this, it is advisable to electronically control fuel injection timing, fuel injection rate, and fuel injection amount. In this case, an electrically operated valve device such as an actuator is necessary.

Prior art electrically operated valve devices, however, have not had sufficient volume to effect direct control of fuel injection. Increase of the volume of such prior art devices, however, slows down the operation of the device and, thus, affects the quick control ability of the device, the object of use of such an electronic system.

To counter this, use has been made of a large volume fluid pressure servo-valve controlled by a small electric valve. This prior art, however cannot effect sufficiently fine adjustment of fuel injection, such as the control of the injection rate.

SUMMARY OF THE INVENTION

An object of the present invention is to provide a flow control device for controlling the pressure in a fuel injection line so as to precisely control fuel injection timing or the fuel injection rate.

Another object of the present invention is to provide a flow control valve which operates fast even with a large amount of fuel passing through the control device.

According to the present invention, there is provided a flow control device arranged between a high pressure line and a relief line for controlling pressure in the high pressure line. The device comprises: a cylinder body having a bore therein; a spool axially movably arranged in the cylinder bore; first and second chambers formed on opposite sides of the spool in the cylinder bore, the spool having a throttle for attaining a fluid connection between the first and second chambers; an electrically operated valve means for selectively opening the first chamber to the relief line; the second chamber being always in connection with the high pressure line; the cylinder body comprising a relief port means located at its inner surface for opening to the relief line and means for defining a stopper portion adjacent to the relief port means; and a means for resiliently urging the spool to abut the stopper portion to disconnect the second chamber from the relief port means. The first chamber is opened to the relief line when the electrically operated valve means is open, causing a pressure difference to be created between the first and second chambers. This moves the spool against the resilient force to open the second chamber to the relief line.

DESCRIPTION OF THE PREFERRED EMBODIMENTS

The present invention is now described with reference to the attached drawings.

Figure 1:
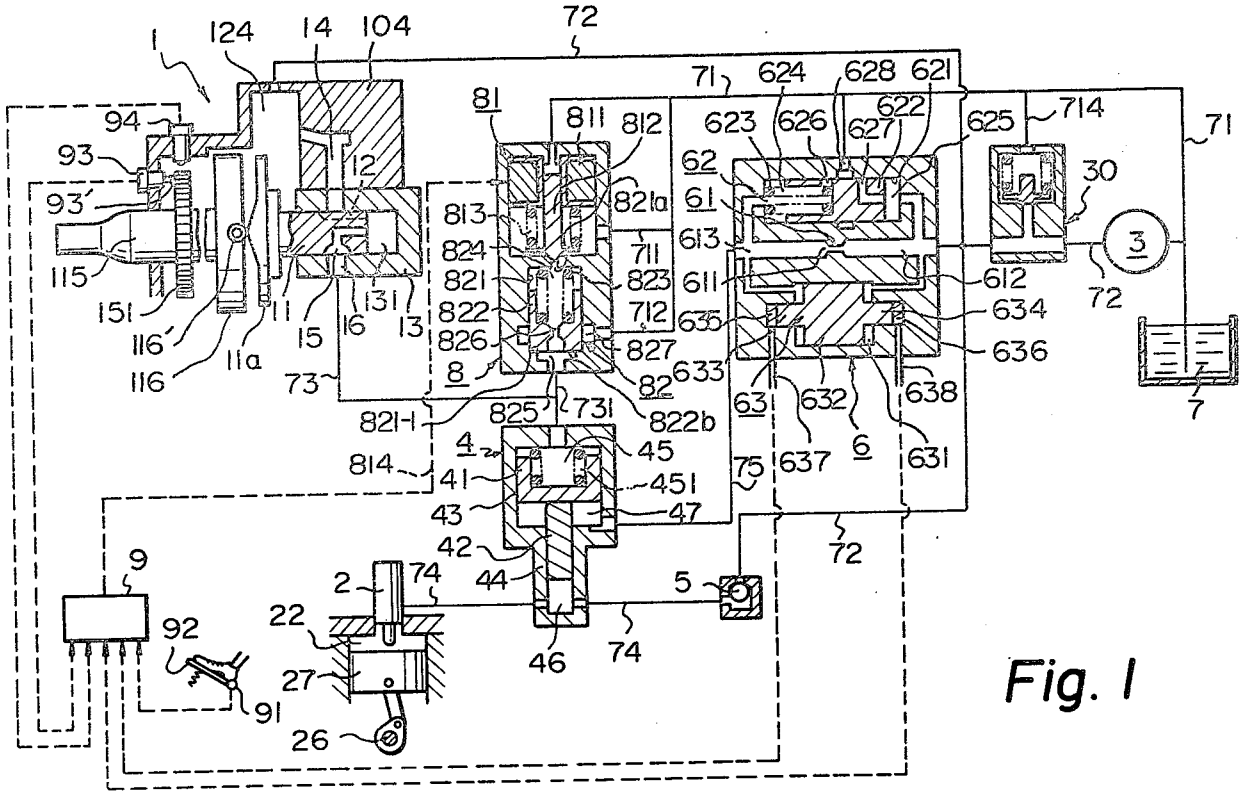
FIG. 1 is a schematic view of a fuel injection system for an internal combustion engine provided with a flow control device according to a first embodiment of the present invention, a servo-system to obtain a very high pressure of fuel to be injected, and a metering device to detect the amount of fuel to be injected.

In FIG. 1 is shown a first embodiment wherein a fuel control device of the present invention is incorporated in a fuel injection control system for an internal combustion engine. In FIG. 1, reference numeral 1 denotes a high pressure pump. In this embodiment, the high pressure pump 1 is a so-called distribution pump normally used as a fuel injection pump for an internal combustion engine. Unlike the normal fuel injection pump, however, the high pressure pump 1 is not necessarily provided with governor and timer units.

The high pressure pump 1 is provided with a plunger 11 which is inserted to a cylinder 13 and is connected in rotation to an input shaft 115 via a coupling (not shown) which allows axial displacement of the plunger 11 with respect to the input shaft 115, which is itsef connected to an engine crankshaft 26 by a not shown connecting device. The plunger 11 has at its one end a face cam 11*a* with which rollers 116′ contact. The rollers 116′ are mounted to a roller ring 116 which is mounted to a pump housing 104. The plunger 11 is operated by the engine crankshaft 26 so that it effects, synchronous with rotation of the engine, reciprocal movement along the longitudinal axis of the plunger while it is rotated.

The plunger 11 has a first recess 12 which is opened to a fuel inlet port 14 in the cylinder 13 during an intake stroke, wherein the plunger 11 moves left in FIG. 1, allowing the fuel from the port 14 to be introduced into a pressure chamber 131 formed between the cylinder 13 and the plunger 11. The plunger 11 has a second recess 15 which is opened to the pressure chamber 131 during an exhaust stroke, wherein the plunger 11 moves right in FIG. 1, allowing the fuel in the pressure chamber 131 to be forced out into a high pressure line 73 via the recess 15 and an outlet port 16.

The plunger 11 starts moving right at a fixed timing earlier than a timing required to energize the injection nozzle 2 to inject fuel into an engine combustion chamber 22 and stops moving right at a fixed timing later than a timing required to deenergize the nozzle 2 to stop the fuel injection.

Fuel from a feed pump 3 is introduced, via a low pressure line 72, into a storage chamber 124 of the high pressure pump 1. The fuel in the chamber 124 is directed to the fuel inlet port 14. The fuel from the outlet port 16 is introduced into a servo-piston device 4 via the high pressure line 73.

The servo-piston device 4 includes a large diameter servo-piston 41, a plunger piston 42 of a smaller diameter, a large diameter cylinder 43, and a small diameter cylinder 44. The servo-piston 41 is slidably arranged in the large diameter cylinder 43, while the plunger piston 42 is slidably arranged in the small diameter cylinder 44. The servo-piston 41 has a lower end which always contacts the upper end of the plunger piston 42. The ratio of the cross-sectional area of the servo-piston 41 to the plunger piston 42 is 9:1.

On one side of the servo-piston 41 remote from the plunger piston 42, a fuel pressure chamber 45 is formed, which chamber 45 is connected to the high pressure line 73. On one side of the plunger piston 42 remote from the servo-piston 42, a pump chamber 46 is formed. Due to the large ratio of the cross-sectional area of the servo-piston 41 to the plunger 11, a very high pressure is obtained in the pump chamber 46, which is equal to the pressure in the fuel pressure chamber 45 multiplied by the above ratio. For example, when the pressure in the fuel pressure chamber 45 is 200 kg/cm$^2$, a pressure of 1800 kg/cm$^2$ can be obtained in the pump chamber 46.

The very high pressure fuel in the pump chamber 46 is supplied to the injection nozzle 2 via an ultra-high pressure line 74. When the pressure in the pump chamber 46 is decreased, fuel from the low pressure line 72 connected to the feed pump 3 is introduced via a one-way valve 5.

The servo-piston device 4 includes a metering chamber 47 formed on one side of the large diameter servo piston 41 adjacent to the plunger piston 42. The device 4 further includes a spring 451 arranged in the pump chamber 45 for urging the servo-piston 41 downwardly. Thus, the speed of upward movement of the servo-piston 41 decreases appropriately when the pressure in the pump chamber 46 is increased, thus preyenting violent collision of the servo-piston 41 to the upper wall of the cylinder 43. The metering chamber 47 is connected to a metering device 6 via a metering line 75.

The metering device 6 includes a throttle portion 61, a pressure regulator portion 62 and a differential pressure sensor portion 63. The throttle portion 61 has a throttle 611, throttle forward chamber 612, and a throttle rear chamber 613. The throttle rear chamber 613 is connected to the metering line 75. The throttle forward chamber 612 and the throttle rear chamber 613 are connected with each other by means of the throttle 611.

The pressure regulator portion 62 is constructed by a cylinder 621, a slide valve member 622, and a spring 623. The slide valve member 622 is arranged in the cylinder 621 in a slidable and fluid-tight manner. On one side of the slide valve member 622, a chamber 624 is formed, which communicates with the throttle rear chamber 613. On the other side of the slide valve member 622, a chamber 625 is formed, which communicates with the throttle forward chamber 612. The spring 623 is arranged in the chamber 624 for urging the slide valve member 622 in right in FIG. 1.

The slide valve member 622 has two axially spaced openings 626 and 627 at its cylindrical outer surface. The opening 626 is opened to the chamber 624 and the opening 627 is opened to the chamber 625. The cylinder 621 has at its inner surface an annular recess 628 opened to a relief line 71, connected to a fuel tank 7. When the pressure in the throttle front chamber 612 is larger than the pressure in the throttle rear chamber 613, the slide valve member 622 moves left in FIG. 1 against the force of the spring 623, causing the opening 627 in the slide valve member 622 to be connected with the annular recess 628, so that pressure in the chamber 625 is decreased.

The pressure regulator portion 62 operates, thus, to maintain a constant pressure difference between the front and rear sides of the throttle 611. Such constant pressure is determined by the force of the spring 623 and is set, for example, to 2 kg/cm$^2$.

It should be noted that fuel in the metering chamber 47 must be allowed to flow back into the throttle rear chamber 613 when the servo-piston 41 moves downward. In this case, the pressure in the throttle forward chamber 612 is maintained to a maximum pressure in the low pressure line 72, for example, 5 kg/cm$^2$, while the pressure in the throttle rear chamber 613 is higher than the pressure in the throttle forward chamber 612. During this condition, the slide valve member 622 moves right in FIG. 1 due to the pressure in the throttle rear chamber 613, until the opening 626 communicates with the annular recess 628.

Contrary to this, when the servo-piston 41 moves upward, a flow through the throttle 611 takes place under the 2 kg/cm$^2$ pressure difference, causing the fuel to be introduced into the metering chamber 47. When the force applied to the servo-piston 41 due to the pressure in the metering chamber 47 equals the force of the spring 451, the servo-piston 41 stops moving. In this case, zero amount of fuel passes the throttle 611. Also, the slide valve member 622 cannot maintain the pressure difference, so the pressures in the throttle front chamber 612, and throttle rear chamber 613 are both maintained to the maximum pressure in the low pressure pipline 72. During this condition, the slide valve member 622 is located so that both the openings 626 and 627 are not connected with the annular recess 628. It should be noted that the spring 623 is under the no load condition.

The differential pressure sensor portion 63 is constructed by a cylinder 631, a large diameter piston 632 sealingly slidable in the cylinder 631, small diameter pistons 633 and 634 extending from the opposite ends of the large diameter piston 632, a first pressure sensor 635 which produces a signal when it is pressed by the small diameter piston 633, and a second pressure sensor 636 which produces a signal when it is pressed by the small diameter piston 634. One end of the piston 632 is opened to the throttle rear chamber 613, while the other end of the piston 632 is opened to the throttle front chamber 612.

Thus, when the pressure in the throttle front chamber 612 is higher than the pressure in the throttle rear chamber 613, the piston 632 moves left in FIG. 1, causing the small diameter piston 633 to press the first pressure sensor 635 to produce a signal. The signal issued from the sensor 635 is introduced into a control circuit 9 via a line 637. When the pressure in the throttle rear chamber 613 is higher than the pressure in the throttle front chamber 612, the large piston 632 is moved right in FIG. 1, causing the small diameter piston 634 to press the second pressure sensor 636. The signal thus issued from the sensor 636 is introduced into the control circuit 9 via a line 638. Piezoelectric elements may be used as pressure sensors 635 and 636.

The system shown in FIG. 1 includes a flow control device 8 according to the present invention for controlling pressure in the high pressure pipeline 73. The device 8 is formed by a solenoid valve 81 as an electrically operated valve and a spool valve 82 as a fluid pressure valve. The spool valve 82 is composed by a cylinder 821, a spool 822, and a spring 823. The spool 822 is arranged in the cylinder 821 so as to axially and sealingly slide in the cylinder 821. In the cylinder 821, a first and a second chambers 824 and 825 are formed on upper and lower ends of the spool 822, respectively. The second chamber 825 is directly connected to the high pressure pipeline 73 via a pipe 731 and is connected to the first chamber 824 via a throttle 826 formed at the central portion of the spool 822. The spring 823 is arranged in the first chamber 824 to urge the spool 822 downward so as to cause the spool 822 to abut at its end face 822*b* a shoulder or stopper portion 821-1 of the cylinder 821. When the pressure in the second chamber 825 is substantially higher than the pressure in the first chamber 824, the spool 822 then moves upward against the force of the spring 823. When the spool 822 is moved up to a position where the lower end of the spool 822 is opened to an annular groove 827 as a main relief port formed in the cylinder 821 at its inner surface, fuel in the second chamber 825 is exhausted to the relief line 71 via a line 712 connected to the annular groove 827.

The first chamber 824 is selectively opened or closed to the relief line 71 via a line 711 by means of the solenoid valve 81. The solenoid valve 81 has a solenoid 811, a valve member 812, and a spring 813. The spring 813 normally urges the valve member 812 downward so that an opening 821*a* is closed as a preliminary relief. When the solenoid 811 is energized the valve member 812 is moved upward against the force of the spring 813 to open the opening 821*a*, causing the fuel in the first chamber 824 to be exhausted to the relief line 71 via line 711. The solenoid 811 is connected to the control circuit 9 via an electric line 814.

Control of the solenoid valve 81 is also effected by the control circuit 9, to which various signals indicating engine load, rotational speed, etc. are introduced. The control circuit 9 energizes or deenergizes the solenoid 811 at an appropriate timing for an appropriate period. A potentiometer 91 is mounted at the acceleration pedal 92 to detect the acceleration degree. A pair of magnetic resistance element (MRE) sensors 93 and 94 are mounted to the pump housing 104 to detect the rotational speed of the input shaft 115, i.e., the rotational speed of the engine, and to detect a predetermined angular position of the input shaft 115, i.e., the predetermined crank angle of the crankshaft 26 of the engine. The sensor 94 is mounted so that it faces an outer peripheral surface of a toothed member 151 connected to the shaft 115. The sensor 93 is arranged to face a projection 93' formed on a side surface of the toothed member 151. The sensor 94 detects the teeth formed on the member 151 along its circumference at a 5 degree pitch. In other words, it provides 72 pulses for every one rotation of the member 151. The sensor 93 issues one pulse to the control circuit 9 every one rotation. The control circuit 9 calculates, on the basis of these signals from the sensors 93 and 94, the timing where the fuel injection is started and is stopped, in order to operate the solenoid 811.

A relief valve 30 is arranged on the low pressure pipeline 72 to which fuel from the fuel tank 7 is supplied by the feed pump 3. The relief valve 30 serves to maintain a constant maximum value of pressure, for example, 5 kg/cm$^2$. When the pressure in the low pressure pipeline 72 exceeds the predetermined value of 5 kg/cm$^2$, the relief valve 30 then opens so that a part of fuel is deflected to the relief line 71 via a pipe 714 so as to decrease the pressure in the low pressure pipeline 72 to the predetermined 5 kg/cm$^2$ value.

Figure 2:
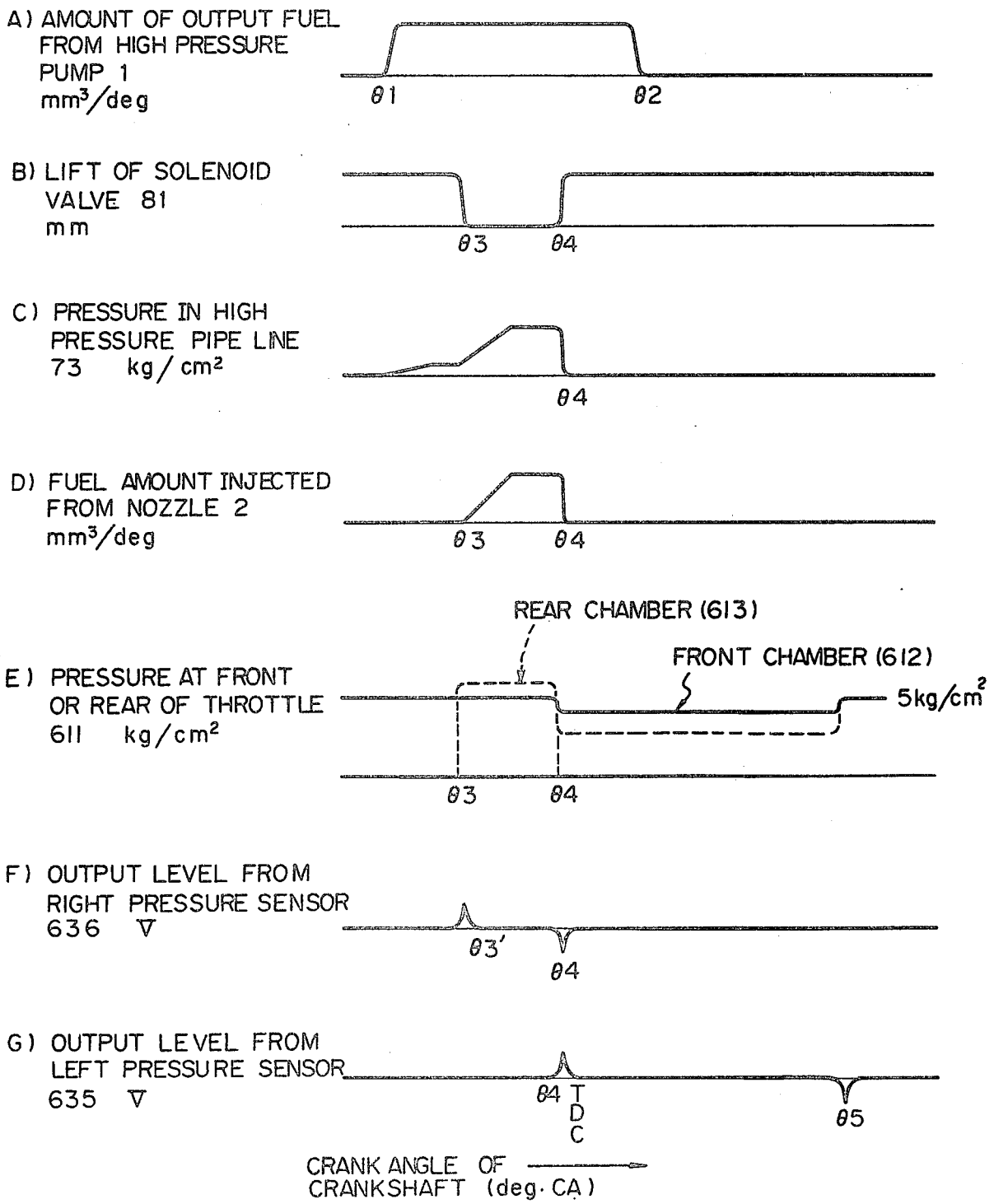
FIG. 2 is a timing chart of the operation of the parts in FIG. 1.

The operation of the embodiment in FIG. 1 will now be described with reference to FIG. 1 and FIG. 2. When a piston 27 of the internal combustion engine has, during the intake stroke thereof, reached to predetermined crank angle $\theta_1$ fully before the top dead center, the plunger 11 of the high pressure pump 1 begins to move right in FIG. 1, so as to force the fuel in the pressure chamber 131 into the high pressure pipeline 73. Until the crank angle reaches a predetermined crank angle value $\theta_3$ the solenoid 811 of the solenoid valve 81 is energized, the valve member 812 to be moved against the force of the spring 813, so that the opening 821*a* as a first relief is opened. Thus, the fuel in the high pressure pipeline 73 forced out of the high pressure pump 1 is issued into the relief line 71 via the second chamber 825, the throttle 826, the first chamber 824, the opening 821*a*, and the line 711. If the amount of the fuel thus relieved is large, the spool 822 would be displaced due to the pressue drop occurring at the throttle 826, so that the fuel may issue via the the annular groove 827. This seldom occurs due to the low rate of increase in the pressure at the low pressure pipeline 72. If it does occur, both the movement of the spool 822 and the amount of the fuel would be very small.

When the piston 27 reaches a predetermined crank angle $\theta_3$ very shortly before the top dead center, the solenoid 811 is deenergized, causing the valve member 812 to be moved downward by the spring 813, so as to close the opening 821*a*. As a result, the pressure in the high pressure pipeline 73, which is continuously supplied by the high pressure pump 1, is abruptly increased.

Due to this increase in the pressure in the high pressure line 73, the servo-piston 41, which was at the uppermost position within a movable range during the opening of the solenoid valve 81, moves downward so as to cause the injection nozzle 2 to supply the fuel into the engine combustion chamber 22 via the ultra high pressure pipeline 74. Due to the downward movement of the servo-piston 41, the pressure in the metering chamber 47 becomes higher than the predetermined level, 5 kg/cm$^2$, in the low pressure pipeline 72, so that the slide valve member 622 of the metering device 6 is moved right in FIG. 1, causing the fuel in the chamber 624 to be issued into the relief line 71 via the annular recess 628. At the same time, the piston 632 is moved right in FIG. 1, causing the pressure sensor 636 to issue a signal to the control circuit 9 at the crank angle $\theta_3'$. The signal indicates the crank angle where the fuel injection is actually initiated. If the actual injection timing differs from the predetermined injection timing, the control circuit 9 operates to modify the crank angle $\theta_3$ to deenergize the solenoid 811 during the subsequent cycle of operation. It should be noted that the crank angle $\theta_3'$ is very slightly later than the crank angle $\theta_3$.

When the piston 27 reaches to a position having a predetermined crank angle $\theta_4$, which is adjacent to the top dead center, the solenoid 811 is energized, causing the solenoid valve 81 to be operated, to open the opening 821*a*. As a result, the spool 822 instantaneously is moved up to a position where the chamber 825 is opened to the annular groove 827, because of a pressure difference created between the chambers 825 and 824. The fuel in the high pressure pipeline 73 is then instantaneously exhausted into the relief line 71 via the chamber 825 and the groove 827.

The servo-piston 41 and the plunger piston 42 stop moving downward and start moving upward, stopping the fuel injection from the nozzle 2. During the upward movement of the plunger piston 42, the fuel from the low pressure pipeline 72 is introduced into the pump chamber 46 because the one-way valve 5 is opened. During the upward movement of the servo-piston 41, the pressure at the throttle forward chamber 612 supplied by the low pressure line 72 becomes higher than the pressure at the throttle rear chamber 613, so that the piston 632 is urged left in FIG. 1, so as to produce a signal introduced into the control circuit 29 at the crank angle $\theta_4$. This signal indicates the start of metering of fuel.

When the servo-piston 41 reaches the uppermost position within its area of movement, the introduction of fuel into the metering chamber 47 is stopped, so that no flow of fuel passing through the throttle 611 takes place. The piston 632 is now urged left in FIG. 1, causing the pressure sensor 635 to issue a signal to the control circuit 9 via line 637 at a crank angle $\theta_5$. This signal indicates the end of the metering period. During this metering period, the amount of fuel introduced into the metering chamber 47 is proportional to the duration of the period $\theta_5$ to $\theta_4$, since the throttle 611 has a fixed area and the pressure drop across the throttle 611 is constant. When the actual amount of fuel differs from the predetermined value calculated by the control circuit 9, the crank angle to start to energize the solenoid 811 during the subsequent cycle is corrected.

It should be noted that, at a predetermined crank angle $\theta_2$ slightly after the top dead center during the metering period, the plunger 11 of the high pressure pump 1 begins its intake stroke, moving left in FIG. 1, to stop the supply of the fuel into the high pressure pipeline 73. Then, the above-mentioned cycle is repeated.

In the above embodiment, the solenoid 811 is not energized to close the solenoid valve 81 while the fuel injection is effected. However, the solenoid valve 81 may be partially opened to effect some pressure relief during the fuel injection period so as to control fuel injection rate.

In the above embodiment, a solenoid valve is used as an electrically operated valve. In place of the solenoid valve, however, a valve which uses the magnetic distortion effect or electric distortion effect may be used. Also, while the solenoid valve 81 and the spool valve 82 of the flow control device in FIG. 1 are formed integrally, they may be constructed separately and be later connected with each other. The throttle 826 formed integrally in the embodiment may also be constructed from pieces separate from each other.

It should be noted that the flow control device 8 can be used not only stop the supply of fuel but also to start it. In this case, the solenoid valve 81 would be constructed such that the closing of the opening 821*a* by the solenoid valve 81 reduces the pressure difference across the spool 822 to move the spool so that the annular groove 827 is closed. Thus a quick stop of the relief of the fuel is attained to start of the injection of the fuel.

As will be clear from the above, pressure relief is directly effected by means of a relatively small solenoid valve 81. Thus quick and variable control is realized, enabling precise control of the fuel injection timing and injection rate. The solenoid valve 82 opens or closes the opening 821*a* which is opened to the first chamber 824 which is connected to the second chamber 825 via the throttle 826. A large amount of relief, which is larger than the volume of the solenoid valve 81, is effected by the spool valve 82. The precise control of the fuel injection enables improved fuel efficiency and reduced engine toxic emission.

Figure 3:
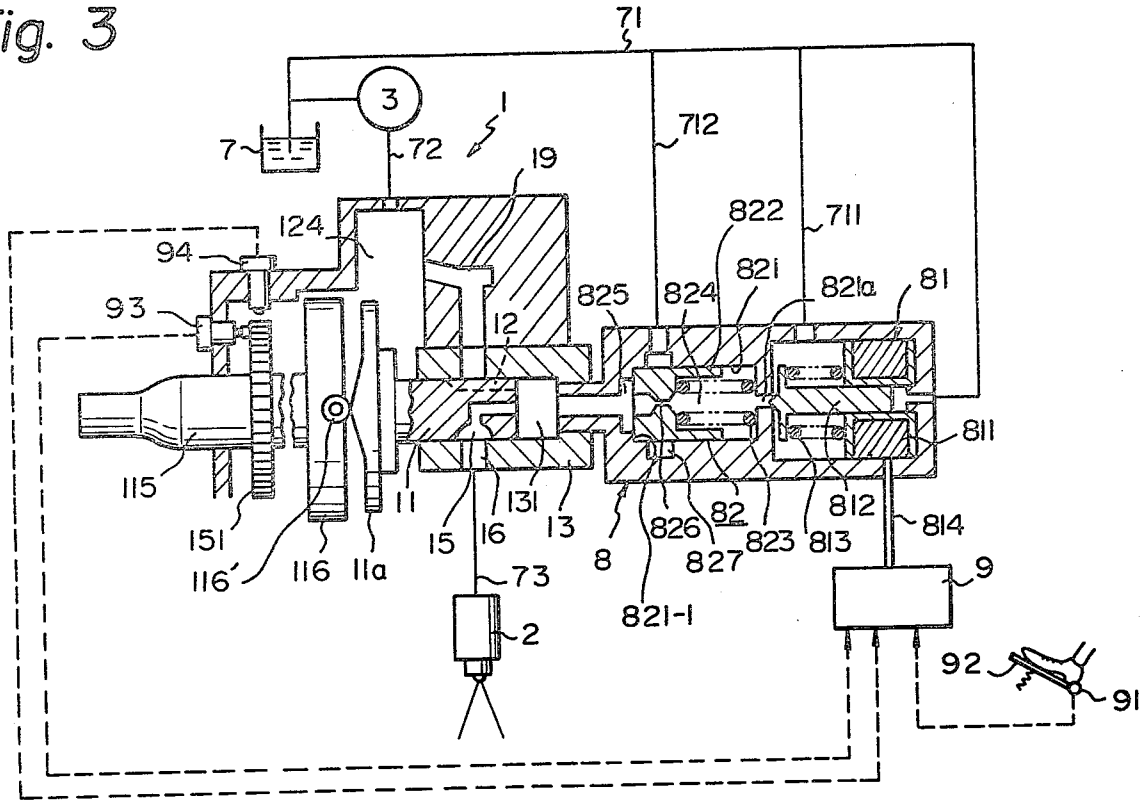
FIG. 3 shows a second embodiment of the present invention wherein a flow control valve is directly coupled with a high pressure pump.

A second embodiment of the present invention is shown in FIG. 3. Members the same as in the first embodiment are inducted by the same reference numerals. The second embodiment differs from the first embodiment of FIG. 1 in that the servo-piston device 4, the one-way valve 5, the metering device 6, and the relief valve 30 are eliminated and in that the fuel control device 8 is directly connected to the cylinder 13 of the high pressure pump 1. The fuel supplied into the storage chamber 124 from the fuel tank 7 by means of the feed pump 3 is introduced into the pressure chamber 131 during the intake stroke of the plunger 11, wherein the plunger 11 moves left in FIG. 1 while the recess 12 is connected with the fuel inlet port 14. The fuel in the pressure chamber 131 is supplied to the injection nozzle 2 via the high pressure pipeline 73 during the exhaust stroke of the plunger 11, wherein the plunger 11 moves right in FIG. 3 while the recess 15 is connected to the outlet port 16.

The fuel control device 8 of the second embodiment also comprises the solenoid valve 81 as the electrically operated valve and the spool valve 82 as the fluid pressure valve. The spool valve 82 has the cylinder 821, spool 822, and spring 823. The spool 822 is shaped a tubular body as axially slidably inserted into the cylinder 821. The first and second chambers 824 and 825, which are connected with each other by means of the throttle, are formed on the sides of the spool. In this embodiment, the second chamber 825 is directly connected to the pressure chamber 131. The spring 823 is arranged in the first chamber 824 for urging one end of the spool 822 to contact the inner shoulder 821-1 formed in the cylinder 821. When the pressure in the second chamber 825 is higher than the pressure in the first chamber 824, the spool 822 is moved right against the force of the spring 823 until the end of the spool 822 is engaged with the annular groove 827, so that the second chamber 825 is opened to the relief line 71 to discharge the fuel.

The first chamber 824 is selectively connected to the relief line 71 by means of the solenoid valve 81. The solenoid valve 81 comprises the solenoid 811, valve member 812, and spring 813. When the solenoid 811 is energized, the valve member 812 is moved against the force of the spring 813 to open the opening 821*a* as a first relief, so that the first chamber 824 is opened to the relief line 71 via the line 711. The solenoid 811 is electrically connected to the control circuit 9 via the line 814.

Figure 4:
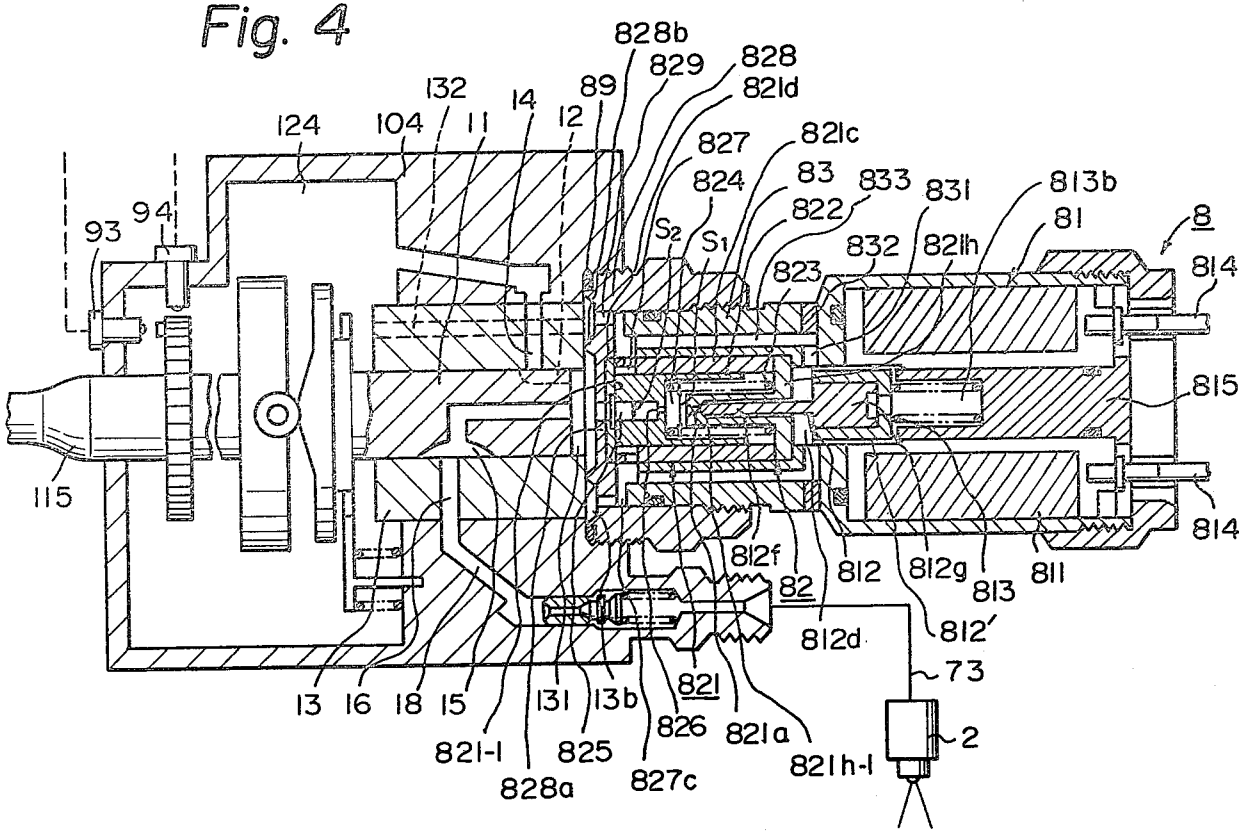
FIG. 4 shows a third embodiment, which is essentially similar to the embodiment in FIG. 3, although modified and improved.

A third embodiment is shown in FIG. 4. This embodiment is basically similar to the embodiment in FIG. 3, but is somewhat improved. The flow control device 8 has a cup-shaped nut member 828 to be screwed to the pump housing 104 and a casing 83 connected to the nut member 828. The cylinder 821 is arranged in the casing 83. The cylinder 821 is constructed by a cylinder member 821*c*, a distance piece 821*d* located on one end of the cylinder member 821c adjacent to the pressure chamber 131 formed between the cylinder 13 and the nut member 828, and a cylinder body 821h located on the other end of the cylinder member 821c. The spool 822 is slidably and sealingly inserted into the cylinder member 821c. The spring 823 urges the spool 822 so that the spool 822 sealingly abuts the distance piece 821d on its end surface. The cylinder constructed by the separate parts 821c, 821d, and 821h facilitates finishing of the sealing surface by grinding or lapping.

The cylinder body 821h is provided at its center with a portion 821h-1 extending coaxially into the spool 822 at a position adjacent to the throttle 826, so that a minimized volume first chamber 824 is formed between the cylinder member 821c, the cylinder body 821h, and the spool 822. An opening 821a is formed as a first relief port at the end of the projection 821h-1. It should be noted that when the spool 822 is closed, the first chamber 824 has an effective area $S_1$ which is larger than an effective area $S_2$ of the second chamber 825. Thus, a force is generated to urge the spool 822 to abut the shoulder portion 821-1 to obtain a closed position of the spool 822.

The annular groove 827 is formed as a second relief port at an inner cylindrical surface of the cylinder member 821c. The annular groove 827 extends to the end surface of the spool 822 facing the distance piece 822b. This construction of the annular groove 827 permits relief of the fuel at the same time the spool 822 begins to move away from the distance piece 821d.

The nut member 828 for connecting the device 8 to the pump housing 104 has an end plate portion 828a opposite to the cylinder 13 of the high pressure pump 1 by way of an o-ring 89 arranged at the outer periphery of the end plate portion 828a. The plate portion 828a is provided with an annular projection 828b spaced inward from the o-ring 89. The annular projection 828b abuts the cylinder 13 so that an annular chamber 13b located around the pressure chamber 131 is formed between the end plate portion 828a and the cylinder 13. This chamber 13b is opened to the storage chamber 124 of the pump 1 via a passageway 132 formed in one side of the cylinder 13 and is opened to the annular groove 827 via holes 829 and an annular chamber 827c.

The solenoid valve 81 is comprised by the solenoid 811, a core 815, an operating member 812' and the valve member 812. The core 815 extends in the solenoid 811. The valve member 812 is provided with a base portion 812g and a needle portion 812f extending from the base portion 812g into a cylinder body 821h. The spring 813 is arranged between the valve member 812 and the core 815, so that an end of the needle portion 812f seats on a shoulder formed in the projected portion 812h-1 adjacent to the opening 812b. It should be noted that a clearance is formed between the needle portion 812f and the portion 821h-1 of the cylinder body 821h, permitting fuel to freely pass through the gap. The gap is opened to a chamber 812d which is opened to the annular chamber 827c via a hole 831 formed in the casing 83 and closed by a cap 832 and via longitudinal holes 833 formed in the casing 83.

The embodiment shown in FIG. 4 operates as follows. When the solenoid 811 is not energized, the needle portion 812f colses the opening 821a so that the first chamber 824 is closed. Thus, the fuel in the pressure chamber 131 is, during the rightward movement of the plunger 11, forced into the outlet port 16 which is opened to the recess 15, and is directed to the injection nozzle 2.

At a predetermined crank angle, in order to end the fuel injection, the solenoid 811 is energized to cause the needle portion 812f to be moved right against the force of the spring 813, to open the opening 821a, so that the first chamber 824 is opened to the storage chamber 124 via a relief line comprised by the chamber 812d, the holes 831 and 833, the chamber 827c, the holes 829, the chamber 13b and the passageway 132.

As a result of this, the pressure of the first chamber 824 is decreased, so that a pressure difference is created with respect to the second chamber 825. Thus the spool 822 is moved against the spring 823 to open the second chamber 825 to the groove 827 in order to stop injection.

This movement of the spool 822 is quickly attained in two ways. First, the portion 821h-1 of the cylinder body 821h is projected into the spool 822 so that the volume of the first chamber 824 becomes as small as possible. Due to the small volume of the first chamber 824, the speed of decrease of pressure in the chamber 824 is high. Thus, the spool 822 is quickly opened. Second, the annular groove 827 extends to the shoulder portion 821-1. Thus, the annular groove 827 is opened to the second chamber 825 at the same time the spool 822 begins to open to detach from the shoulder 821-1.

It should be noted that the groove 827 in the embodiment in FIG. 1 or 3 terminate at a position spaced from the shoulder portion 821-1. Thus, the relied does not take place at the same time when the spool 822 begins to move but takes place after the spool 822 is moved to the groove 827.

The embodiment shown in FIG. 4 also differs from the embodiment in FIG. 3 in that the fuel is return back to the storage chamber 124 via the annular chamber 13b and the passageway 132 in the pump cylinder 13. This means that no relief line outside of the device is necessary, permitting a compact device construction.

Figure 5:
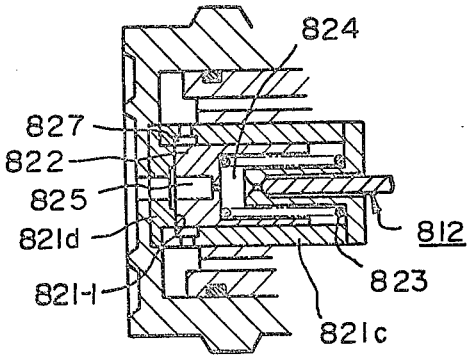
FIGS. 5 and 6 partially show modifications of the embodiment in FIG. 4.

A slight modification is shown in FIG. 5. The distance piece 821d has a cylindrical projection which is inserted to the cylinder member 821c. An end surface of the projection forms the shoulder portion 821-1 to which the spool 822 abuts. The second chamber 825 may open to the groove 827 at the same time the spool 822 begins to move.

Figure 6:
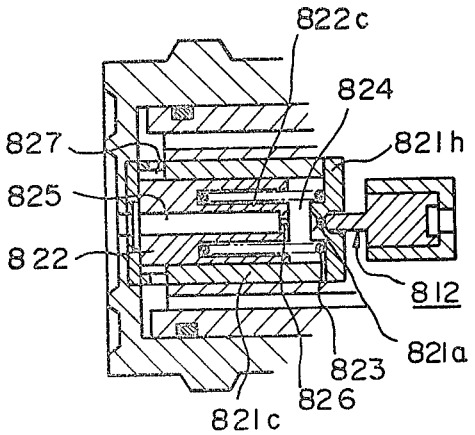

Another slight modification is shown in FIG. 6. In this embodiment, in place of the projected portion 821h-1 extending to the spool 822 as in FIG. 4, the spool 822 is provided with a portion 822c projecting to the cylinder body 821h, so that a restricted volume first chamber 824 is created. Thus, a pressure difference to cause the spool 822 to move against the spring 823 to open the second chamber 825 with the groove 827 is guickly realized when the valve member 812 is detached from the cylinder body 821h to open the opening 821a.

Figure 7:
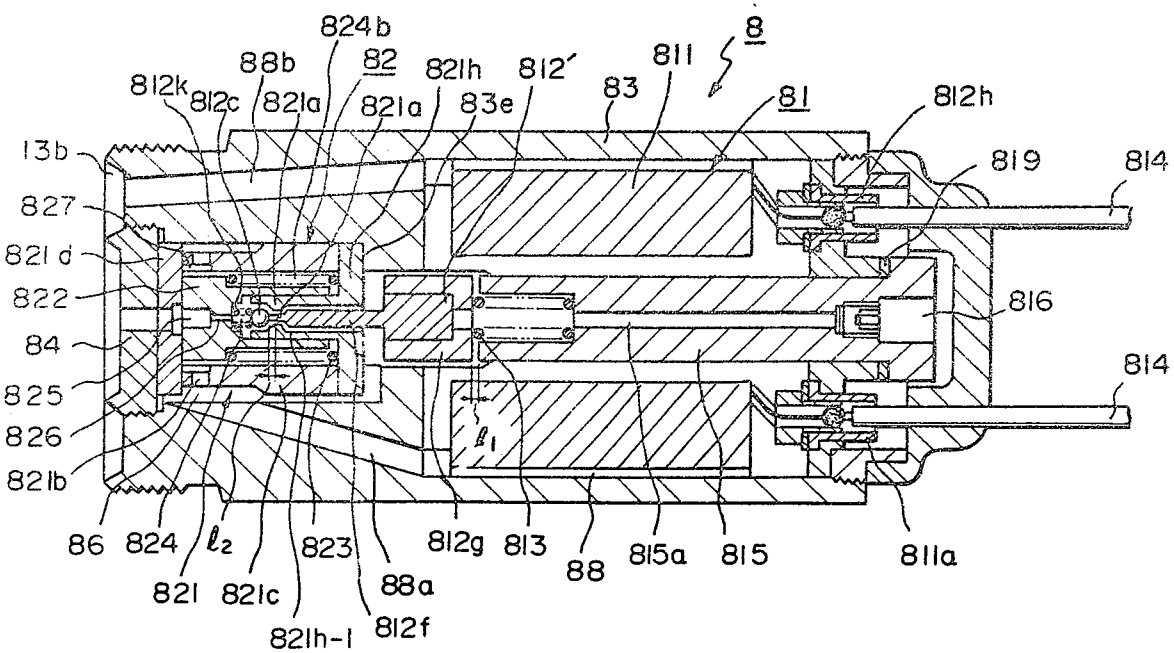
FIG. 7 shows another embodiment of the flow control device of the present invention.

Another embodiment in FIG. 7 shows the flow control device 8 alone. The device 8 has the casing 83 which is screwed into a fuel pump housing (not shown). In the casing 83 the cylinder 821 is arranged. The cylinder 821 is comprised of the cylinder member 821c, cylinder body 821h, and distance piece 821d. These parts 821c, 821h and 821d are inserted to a cylinder bore 83e of the casing 83 and is fixed in positions by a plate member 84. The annular groove 827 is formed in the cylinder member 821c which is opened to an annular chamber 86 formed around the cylinder member 821c in the cylinder bore 83e.

This embodiment differs from the preceding embodiment in FIG. 4 in that the solenoid valve 81 is a normally open type. The solenoid valve 81 comprises a valve member 812*c* of a ball shape arranged in the first chamber 824. The valve member 812*c* is urged by a spring 812*k* toward the opening 821*a*. The solenoid 81 includes the operating member 812' having a base portion 812*g* located on one side of the cylinder body 821*h* remote from the spool 822, and a needle portion 812*f* extending into the cylinder body 821*h*. The spring 813 is arranged between the base portion 812*g'* and a solenoid core 815 to urge the needle portion 812*f* to extend out of the opening 821*a* to open the valve member 812*c* against the force of the spring 12*k*. The core member 815 has a longitudinal opening 815*a* through which a measurement instrument such as a micrometer is introduced to measure the lift of the operating member 812'. The opening 815*a* is closed by a cap 816. The solenoid 811 is arranged in a chamber 88 which is on one hand connected to the chamber 86 via a passageway 88*a* and on the other hand connected to the annular chamber 13*b* via a passageway 88*b*.

During the injection, the solenoid 811 is energized to move the operating member 812' against the spring 813, so that the needle portion 812*f* is detached from the valve member 812*c*, causing the valve member 812*c* to close opening 821*a*. In this case, the lift $l_1$ of the operating member 812' is adjusted so that it is larger than lift $l_2$ of the valve member 812*c*. Such adjustment is effected by selecting a proper thickness of a shim 819. In order to measure the lift, a measurement instrument such as a micrometer would be inserted via the opening 815*a*. After the adjustment is completed the opening 815*a* is closed by the cap 816.

When injection is to be ended, the solenoid 811 is deenergized, so that the operating member 812' is moved by the spring 813 to push the valve member 812*c* away from the spool 822, causing the chamber 824 to be opened to the opening 821*a*. Thus, the fuel is returned to a pump (not shown) via a gap between the needle portion 812*f* and the cylinder body 821*h*, the chamber 89, the passageway 88*a*, the solenoid chamber 88, the passageway 88*b*, the annular chamber 136 and a passageway (not shown) which is similar to 44 in FIG. 4. Thus, the injection is stopped.

The solenoid chamber 88 serves to allow the solenoid 811 to touch the recirculating fuel when the relief takes place. Thus, the solenoid 811 is effectively cooled to maintain its temperature. Thus, proper control of the valve lift is realized.

In this embodiment, since the solenoid valve 81 is of a normally open type wherein the opening 821*a* is opened when the solenoid 811 is not energized and since a separate ball shaped valve member 812*c* is used to close the opening 821*a*, the seal of the first chamber 824 is easily attained since precise machining of the needle portion 812*f* as well as cylinder body 821*h* is not necessary. Contrary to this, in the embodiment in FIG. 4, precise machining of the needle portion 812*f* as well as the cylinder body 821*h*, which is very difficult, is necessary to attain a proper seal.

Further, in this embodiment, since the solenoid 81 is of a normally open type, when the control circuit 9 malfunctions, the first chamber 824 is opened to the relief line (not shown in FIG. 7) at any moment. Thus excessive increase of pressure in the line connecting the high pressure pump and the injection nozzle, which are not shown in FIG. 7, which would otherwise take place, may be prevented.

Figure 8:
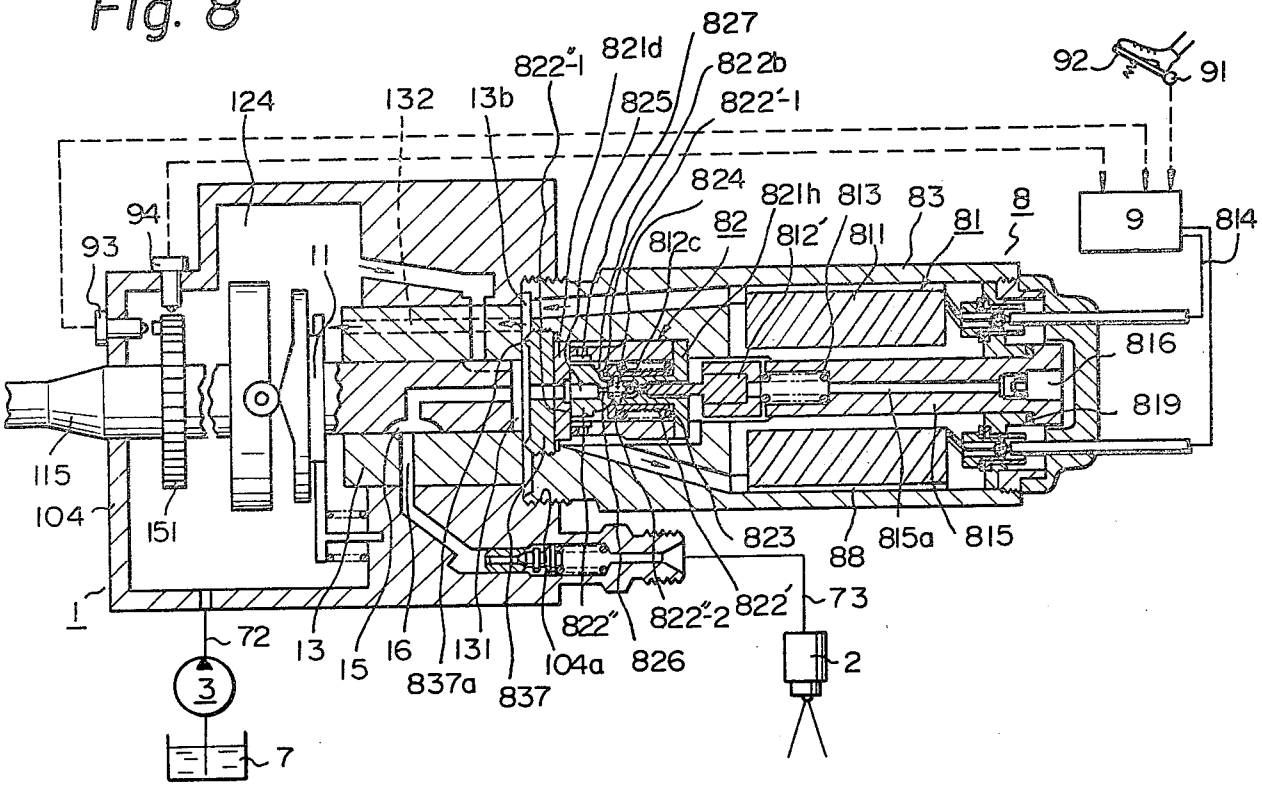
FIG. 8 shows a fuel injection system integrally provided with a flow control valve of the present invention of another embodiment.
Figure 9:
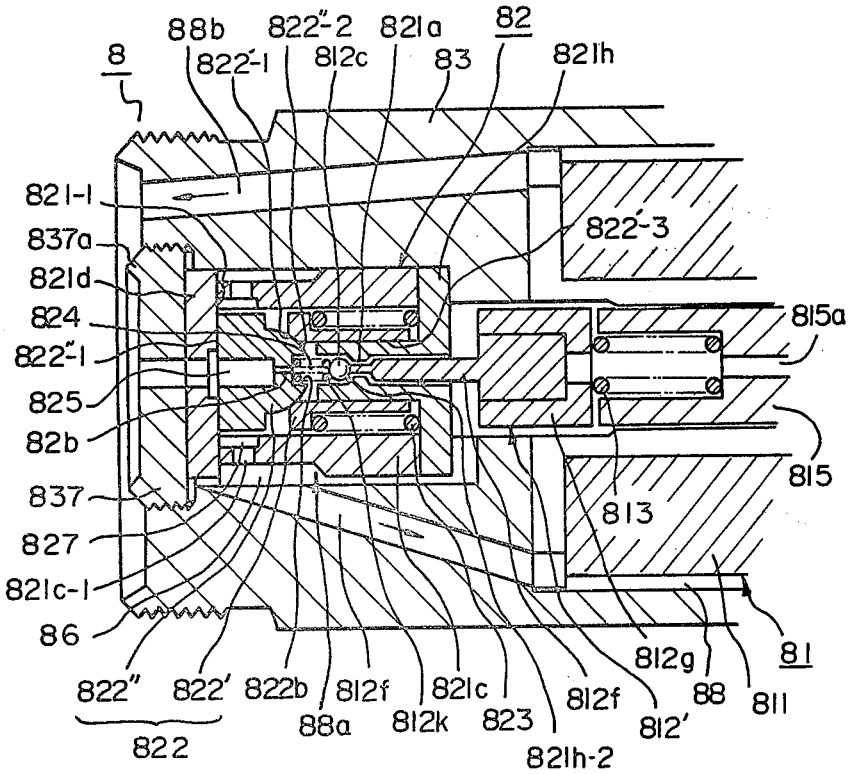
FIG. 9 is a partial enlarged view of FIG. 8.

Another embodiment is shown in FIGS. 8 and 9. The embodiment differs from the embodiment in FIG. 7 in that the spool 822 is constructed by two separate members 822' and 822'', as will be described fully later.

The flow control device 8 in FIGS. 8 and 9 includes the casing 83 screw connected to a thread bore 104*a* of a pump housing 104. The casing 83 is, at its end facing the cylinder 13, connected to a plate piece 837 screwed to the pump housing 104. The piece 837 is provided with an annular projection 837*a* contacting with the cylinder 13 at its end, so that the pressure chamber 131 and the annular chamber 13*b* are formed.

The device 8 comprises the solenoid valve 81 and the spool valve 82. The spool valve 82 has the cylinder 821 comprised of the cylinder member 821*c*, distance piece 821*d*, and the cylinder body 821*h* and has the spool 822 comprised by two separate members 822' and 822''.

The spring 823 urges the spool 822 so as to contact the shoulder portion 821-1 formed by the distance piece 821*d*. The solenoid valve 81 has the valve member 812*c* of a ball shape arranged in the first chamber 824, the operating member 812' comprised by the base portion 812*g* and a needle portion 812*f* extending therefrom, the core 815, the spring 813 urging the operating member 812' so that the valve member 812*c* is, against the force of the spring 812*k*, detached from the valve seat to open the opening 821*a* and the solenoid 811. The core 815 is provided with a longitudinal opening 815*a* to detect the lift of the member 812. The lift of the member 812 is adjusted to be is higher than the lift of the valve member 812*c* by selecting the thickness of the shim 819. The solenoid 811 is arranged in a chamber 88 which is a part of a relief line, constructed by holes 821*c*-1, the annular chamber 86, the passageway 88*a*, the solenoid chamber 88, the passageway 88*b*, the annular chamber 13*b*, and the passageway 132 formed in the cylinder 13 of the pump 1. These are similar to the embodiment in FIG. 7.

The spool 822 of the embodiment is constructed by two separate pieces, that is, an end surface seal spool 822'' and a cylindrical surface seal spool 822'. The end surface seal spool 822'' sealingly abuts the shoulder portion 821-1 at its end face 822''-1, while the cylindrical surface spool 822' sealingly slides in the cylinder body 821*h*. The end surface seal spool 822'' has a spherical portion 822''-2 projected toward the cylindrical surface seal spool 822', while the cylindrical surface seal spool 822' has a conical inner portion 822'-1 at its end facing the end surface seal spool 822''. The spring 823 urges the conical inner portion 822'-1 so it sealingly abuts the spherical portion 822''-2.

During the operation of the device 8, the control circuit 9, responsive to signals from the sensors 93 and 94 for detecting the crank angle and rotational speed respectively, energizes the solenoid 811 so that the spool valve 822 is closed since the needle portion 812*f* is detached from the valve member 812*c* to close the opening 821*a*. Thus, the pressure in the chamber 131 can increase when the plunger 11 moves right, so that the fuel is introduced via the recess 15 and the outlet port 16 to the injection nozzle 2 to effect fuel injection. During this, the end surface seal spool 822'' provides a seal function at its end surface 822''-1, while the cylindrical surface seal spool 822' provides a seal function at its cylindrical surface 822'-3. The spools 822' and 822'' are sealed with each other between the conical and the spherical portions 822'-1 and 822''-2. Due to the independent structure of the end surface seal spool 822'' for sealing the end surface and of the cylindrical surface seal member 822' for sealing the cylindrical surface, such a seal is effectively attained without any difficulty in machining the spools 822' and 822''.

The control circuit 9 is operated to deenergize the solenoid 811 when the fuel injection is to be stopped. Thus the needle portion 812*f* of operating member 812' pushes the valve member 812*c* so that it is detached from the valve seal 821*h*-2 to open the opening 821*a*. Thus preliminary relief is attained by opening the small valume first chamber 824. Then, main relief is attained by opening the second chamber 825.

Figure 10:
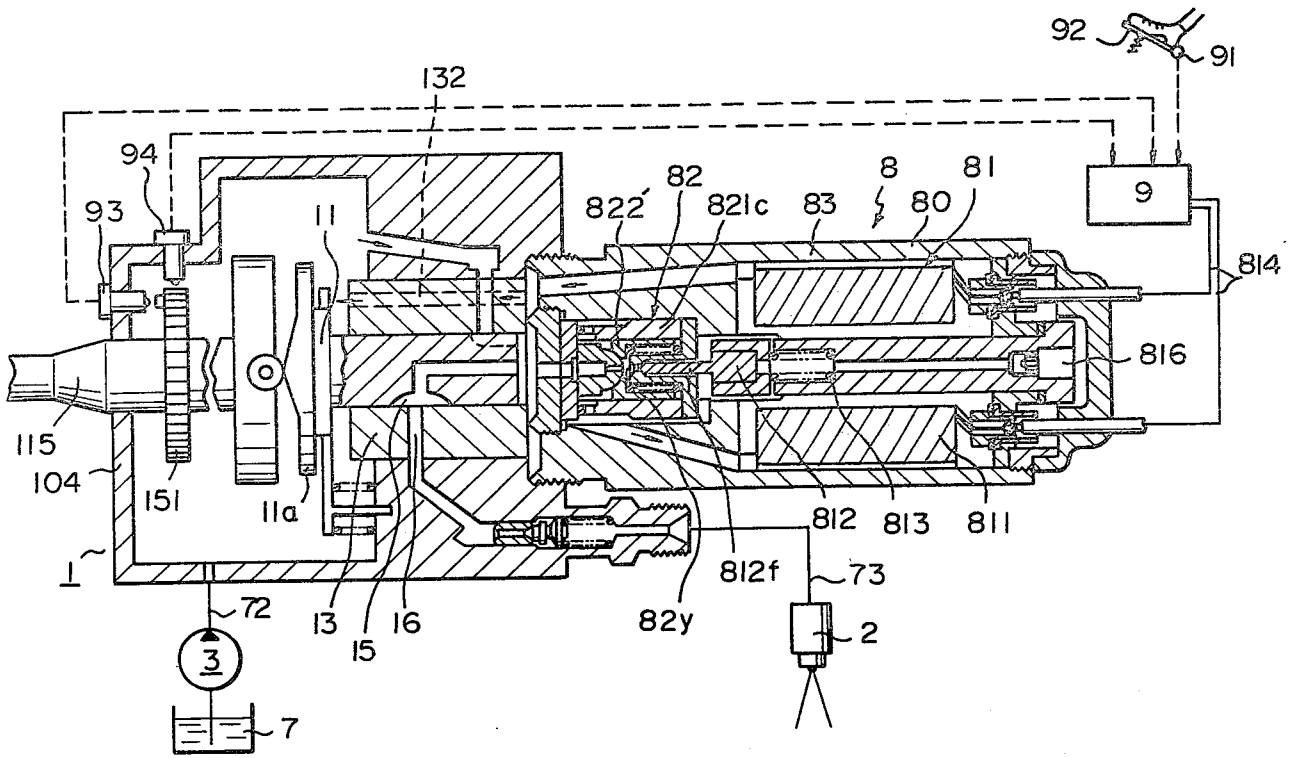
FIG. 10 shows a fuel injection system integrally provided with a flow control valve of still another embodiment.

Another embodiment is shown in FIG. 10. This embodiment is similar to that in FIGS. 8 and 9 except that the solenoid valve 81 is of a normally closed type wherein, when the solenoid 811 is deenergized, needle portion 812*f*, closes the first chamber 824 and that the cylindrical surface seal spool 822' is sealed at its outer cylindrical surface to the cylinder member 821*c*.

While embodiments of the present invention have been described with reference to the attached drawings, many modifications and changes may be made by those skilled in this art without departing from the scope of the invention.

We claim:

1. A flow control device arranged between a high pressure line and a relief line for control of pressure in the high pressure line, said device comprising:

a means for defining a cylinder bore;

a spool axially movably arranged in the cylinder bore;

first and second chambers formed on opposite sides of the spool in said cylinder bore, the spool having a throttle for attaining a fluid connection between the first and second chambers;

an electrically operated valve means for selectively opening the first chamber to the relief line, the second chamber being always in connection with the high pressure line;

a relief port means located at an inner surface of the cylinder bore for opening to the relief line;

a means for defining a stopper portion adjacent to said relief port means; and a means for resiliently urging the spool to abut the stopper portion to disconnect the second chamber from the relief port means, whereby the first chamber is opened to the relief line when the electrically operated valve means is open, causing a pressure difference to be created between the first and second chamber, to move the spool against the resilient means to open the second chamber to the relief line.

2. A device according to claim 1, wherein said relief port means extendes to said stopper portion, whereby the second chamber is opened to the relief port means at the same time when the spool is detached from the stopper portion.

3. A device according to claim 1, wherein said spool has, at its side adjacent to stopper portion, an inner effective area which is smaller than an effective area at the other side of the spool, whereby a positive contact is attained between the spool and the stopper portion while the spool is closed.

4. A device according to claim 1 wherein said means for defining a cylinder bore comprises a cylinder member within which the spool slides, a distance piece arranged on one end of the cylinder member adjacent to the high pressure line, said distance piece defining said stopper portion, and a cylinder body having a base portion connected to the other end of the cylinder member and a tubular boss portion having an end defining an opening, and wherein said electrically operated valve means comprises a valve member located adjacent to said opening in the cylinder body, an operating member connected with the valve member, biasing mean for biasing the valve member, and an electrically operating means for operating the operating member for selectively opening or closing the opening so that the first chamber is selectively connected to or disconnected from the relief line.

5. A device according to claim 4, wherein said spool has a recess on one side facing the cylinder body and wherein said boss portion extends into the recess, whereby first chamber attains as small a volume as possible.

6. A device according to claim 4, wherein said spool has an inner boss portion where said throttle is defined, said inner boss portion extending toward the boss portion of the cylinder body, whereby the first chamber attains as small a volume as possible.

7. A device according to claim 4, wherein said distance piece has a cylindrical projection fitted to the spool, the cylindrical projection defining, at its end surface, said stopper portion.

8. A device according to claim 4, wherein the spool is, at its inner cylindrical surface, sealingly slidable with respect to the cylinder body.

9. A device according to claim 4, wherein the spool is, at its outer cylindrical surface, sealingly slidable with respect to the cylinder body.

10. A device according to claim 4, wherein said operating member is arrange on one side of the cylinder body remote from the spool, wherein said valve member forms a needle portion extending integrally from the operating member, and wherein said biasing means urges the valve member so that it normally closes the opening.

11. A device according to claim 4, wherein said valve member is a separate member arranged in the first chamber, the separate member is urged to close the opening, wherein the operating member comprises a base portion arranged on one side of the cylinder body remote from the spool and a needle portion extending from the base portion, and wherein said biasing means urges the operating member so that it normally extends out of the opening to lift the valve member to open the opening.

12. A device according to claim 4, wherein said electrically operating means comprises a core member arranged on one side of the operating member at a small distance therefrom and a solenoid member arranged around the core member.

13. A device according to claim 12, wherein said core member is provided with a longitudinal opening which is in its one end opened to said operating member, and in its the other end releasably closed by a cap, wherein said electric operating means further includes a shim member adjusting a lift of the valve member.

14. A device according to claim 12, wherein it further includes a means for defining a solenoid chamber around a solenoid, which solenoid chamber is located in the relief line to cool the solenoid member by the recirculated flow of fluid.

15. A valve device according to claim 1, wherein said spool comprises a first member attaining a seal contact with the stopper portion, and a second member of tubular shape attaining a seal contact with the cylinder body, said second member having an end surface which is urged to sealingly contact the facing end surface of the first member.

16. A valve member according to claim 15, wherein one of the end surfaces forms a conical surface while the other forms a spherical surface.

17. A flow control device according to claim 1 wherein said relief port means comprise an annular groove at an inner surface of the cylinder bore, said means for defining a cylinder bore having at least one hole connecting the annular groove with the relief line.

18. A flow control device according to claim 1, said stopper portion is an annular shoulder at an inner surface of the cylinder bore.

19. A fuel injection system for an internal combustion engine, comprising:

a fuel tank;

a high pressure pump operated by the engine, a fuel injection means for introduction of fuel into the engine;

a high pressure line for connecting the high pressure pump to the fuel injection means;

a relief line for discharging excess fuel into the tank;

a flow control device comprising a casing;

a means arranged in the casing for defining a cylindrical bore;

a spool axially movably arranged in the cylinder bore;

first and second chambers formed on opposite side of the spool in said cylinder bore, the spool having a throttle for attaining a fluid connection between the first and second chambers;

an electrically operated valve means for selectively opening the first chamber to the relief line;

the second chamber being always in connection with the high pressure line;

said means for defining the cylinder bore comprising a relief port means at its inner surface for opening to the relief pressure line and means for defining a stopper portion adjacent to said groove;

a means for resiliently urging the spool to abut the stopper portion to disconnect the second chamber from the relief port means; and a means for controlling the operation of the electrically operated valve means in accordance with the operational condition of the engine for controlling fuel injection of the internal combustion engine.

20. A fuel injection system according to claim 19, wherein said high pressure pump has a plunger, a cylinder to which the plunger is reciprocatably inserted a pressure chamber formed on one side of the plunger in the cylinder, a storage chamber in which fuel is stored, a means for connecting the storage chamber with the pressure chamber when the plunger moves in one side to increase the volume of the pressure chamber to introduce fuel into the pressure chamber, and a means for connecting the pressure chamber with the high pressure line when the plunger moves in the other side to decrease the volume of pressure chamber, to issue the fuel into the high pressure line, and wherein said casing is connected to the cylinder of the high pressure pump so that the second chamber is opened to the pressure chamber.

21. A fuel injection system according to claim 20, wherein said casing has, at its end facing the cylinder of the pump, an annular projection in sealing contact with the end of the cylinder so that the pressure chamber is formed inside the projection and an annular relief chamber is formed around the pressure chamber, the cylinder of the pump defines a longitudinal passageway which is on one end opened to the annular chamber and is on the other end opened to the storage chamber, and said casing further has relief passageway means for connecting said annular relief chamber with the annular groove, whereby the relief line is created in the casing and the pump cylinder.

22. A device according to claim 19 wherein said relief port means extends to said stopper portion, whereby the second chamber is opened to the relief port means at the same time when the cylindrical valve member is detached from the stopper portion.

23. A device according to claim 19, wherein said spool has, at its side adjacent to the stopper portion, an inner effective area which is smaller than an inner effective area at the other side of the spool, whereby a positive contact is attained between the valve member and the stopper portion while the valve is closed.

24. A valve device according to claim 19 wherein said means for defining the cylinder bore comprises a cylinder member with which the spool slides, a distance piece arranged on one end of the spool adjacent to the pressure line, said distance piece defining said stopper portion and a cylinder body having a base ring portion connected to the other end of the cylinder member and a tubular boss portion having an end defining an opening, and wherein said electrically operated valve means comprises a valve member located adjacent to said opening in the cylinder body, an operating member connected to the valve member, a biasing mean for biasing the operating member and an electrically operating means for operating the operating member for selectively opening or closing the opening so that the first chamber is selectively connected to or disconnected from the relief line.

25. A valve device according to claim 24, wherein said spool has a recess on one side facing the cylinder body and wherein said boss portion extends into the recess, whereby the first chamber attains as small a volume as possible.

26. A valve device according to claim 24 wherein said spool has an inner boss portion where said orifice is defined, said boss portion extending toward the boss portion of the cylinder body, whereby the first chamber attains as small a volume as possible.

27. A valve device according to claim 24, wherein said distance piece has a cylindrical projection inserted to the spool, the cylindrical projection defining, at its end surface, said stopper portion.

28. A valve device according to claim 24, wherein the spool is, at its inner cylindrical surface, sealingly slidable with respect to the cylinder body.

29. A valve device according to claim 24, wherein the spool is, at its outer cylindrical surface, sealingly slidable with respect to the cylinder body.

30. A valve device according to claim 24, wherein said operating member is arranged on one side of the cylinder body remote from the spool, wherein said valve member forms a needle portion extending integrally from the operating member, and wherein said biasing means urges the needle portion so that it normally closes the opening.

31. A valve device according to claim 24, wherein said valve member is formed as a separate member arranged in the first chamber, the separate member is urged normally to close the opening, wherein said operating member comprises a base portion arranged on one side of the cylinder body remote from the spool and a needle portion extending from the base portion, and wherein said biasing means urges the operating member so that it normally extends out of the opening to lift it to open the opening.

32. A valve device according to claim 24, wherein said electric operating means comprises a core member arranged on one side of the operating member at a small distance therefrom and a solenoid member arranged around the core member.

33. A valve device according to claim 32, wherein said core member is provided with a longitudinal opening which is in its one end opened to said operating member and is at its other end releasably fitted by a cap, wherein said electrically operated means further includes a shim member arranged between the casing and a portion of the core extending out of the casing for adjusting a lift of the valve member.

34. A valve device according to claim 32, wherein said casing has a chamber around the solenoid, which chamber is located in the way of the relief line to cool the solenoid member.

35. A valve device according to claim 19, wherein said spool comprises a first member, attaining a seal contact with the shoulder portion, and a second member of tubular shape, attaining a seal contact with the cylinder body, said second member having an end surface which is urged to sealingly contact the facing end surface of the first member.

36. A valve member according to claim 35, wherein one of the end surfaces forms a conical surface while the other surface forms a spherical surface.

37. A flow control device according to claim 19 wherein said relief port means comprise an annular groove at an inner surface of the cylinder bore, said means for defining a cylinder bore having at least one hole connecting the annular groove with the relief line.

38. A flow control device according to claim 19, said stopper portion is an annular shoulder at an inner surface of the cylinder bore.

39. A fuel injection system for an internal combustion engine, comprising:

a fuel tank;

a high pressure pump operated by the engine;

a fuel injector means for introduction of fuel into the engine;

a low pressure line for connecting the fuel tank with the pump;

a high pressure line for connecting the high pressure pump to fuel injector;

a relief line for returning excess fuel to the tank;

a pressure multiplying means arranged in the high pressure line for obtaining a high pressure of fuel to be supplied to the fuel injector means;

a metering means for setting an amount of fuel to be directed to the injector;

a flow control device comprising:

a means for defining a cylinder bore;

a spool axially movably arranged in the cylindrical bore;

first and second chambers formed on opposite side of the spool in said bore, the spool having a throttle for attaining a fluid connection between the first and second chambers;

an electrically operated valve means for selectively opening the first chamber to the low pressure line;

the second chamber being always in connection with the high pressure line;

said means for defining the cylinder bore comprising a relief means at its inner surface for opening to the relief line and means for defining a stopper portion adjacent to said relief port means; and a means for resiliently urging the spool to abut the stopper portion to disconnect the second chamber from the relief port means; and a means for controlling the operation of the electrically operated valve means so that said opening is closed and opened at selected crank angles of the engine to control the amount of fuel to be measured by the metering means so as to correspond to a predetermined value at an operating condition of the engine.

40. A system according to claim 39, wherein said pressure multiplying means comprises a cylinder of a large diameter, a cylinder of small diameter which is connected the large diameter cylinder in series, a large diameter servo-piston sealingly and slidably fitted to the large diameter cylinder, a small diameter plunger sealingly and slidably fitted to the small diameter cylinder, a fluid pressure chamber being formed on one side of the large diameter servo-piston remote from the plunger piston, the fluid pressure chamber being in communication with the high pressure line, a metering chamber being formed between the servo-piston and the plunger, the metering chamber being in communication with the metering means, a pump chamber is formed on one side of the plunger remote from the servo-piston, the pump chamber being in connection with the fuel injector means, and a one-way valve means arranged between the pump chamber and the low pressure line.

41. A system according to claim 40, further including a spring arranged in the fluid pressure chamber for urging the servo-piston to increase the volume of the fluid pressure chamber.

42. A system according to claim 39, wherein said metering device comprises a throttle forward and throttle rear chambers connected with each other by a throttle, the throttle forward chamber being in connection with the low pressure line, the throttle rear chamber being in connection with the metering chamber of the multiplying means, a first control means responsive to the pressure difference between the throttle forward and rear chambers to selectively connect the throttle forward or rear chamber to the relief line, and a second control means for response to the pressure difference between the throttle forward and rear chambers, to issue a signal indicating the start and stop of fuel injection introduced into the control means.

43. A system according to claim 42, wherein said first control means comprises a cylinder and a slide valve member arranged therein, chambers being formed on sides of the slide valve member and being in connection with the throttle forward and rear chambers, respectively, said cylinder having an annular recess always opened to the relief line, said annular opening being selectively connected to one of the chambers on the sides of the slide valve member.

44. A system according to claim 42, wherein said second control means comprises a cylinder of a large diameter, cylinders of small diameter, a large diameter piston arranged in the first cylinder, the sides of the cylinder being opened to the throttle forward and rear chambers, respectively, and small diameter pistons arranged in the small diameter cylinders, respectively, and first and second transducers responsive to the movement of the small diameter piston, respectively, to issue a signal indicating the pressure difference between the throttle forward and rear chambers.

45. A system according to claim 44, wherein said first and second transducers are pressure sensitive sensors to issue electric signals in accordance with pressure applied thereto by the respective small diameter pistons.

* * * * *